US007766652B2

(12) United States Patent
Orton

(10) Patent No.: US 7,766,652 B2
(45) Date of Patent: Aug. 3, 2010

(54) FIRED POTTERY ITEMS AND A METHOD FOR THEIR MANUFACTURE

(76) Inventor: Denis George Orton, 107 Wakerobin Rd., Williamsburg, VA (US) 23185

( * ) Notice: Subject to any disclaimer, the term of this patent is extended or adjusted under 35 U.S.C. 154(b) by 1359 days.

(21) Appl. No.: 11/029,277

(22) Filed: Jan. 5, 2005

(65) Prior Publication Data

US 2008/0131829 A1 Jun. 5, 2008

Related U.S. Application Data

(60) Provisional application No. 60/534,238, filed on Jan. 6, 2004.

(51) Int. Cl.
*F27B 14/00* (2006.01)

(52) U.S. Cl. ..... 432/156; 432/258

(58) Field of Classification Search ..... 432/156, 432/258

See application file for complete search history.

(56) References Cited

U.S. PATENT DOCUMENTS

| | | | | | |
|---|---|---|---|---|---|
| 585,765 | A * | 7/1897 | Jeffery | 432/200 |
| 971,228 | A * | 9/1910 | Vance | 432/258 |
| 1,937,450 | A * | 11/1933 | Weber, Jr. | 432/258 |
| 3,681,818 | A * | 8/1972 | Di Stefan | 432/258 |
| 4,102,653 | A * | 7/1978 | Simmons et al. | 44/557 |
| 4,215,265 | A * | 7/1980 | White | 219/390 |
| 6,565,820 | B1 * | 5/2003 | Weimer et al. | 423/240 S |
| 6,615,463 | B1 * | 9/2003 | Hojaji | 27/1 |
| 6,945,181 | B2 * | 9/2005 | Tanner | 110/348 |

* cited by examiner

*Primary Examiner*—Gregory A Wilson
(74) *Attorney, Agent, or Firm*—Kimberly A. Chasteen

(57) ABSTRACT

Pottery wares are fired in a saggar in an electric kiln, whereby effects such as reduction firing and soda firing may be obtained.

2 Claims, 1 Drawing Sheet

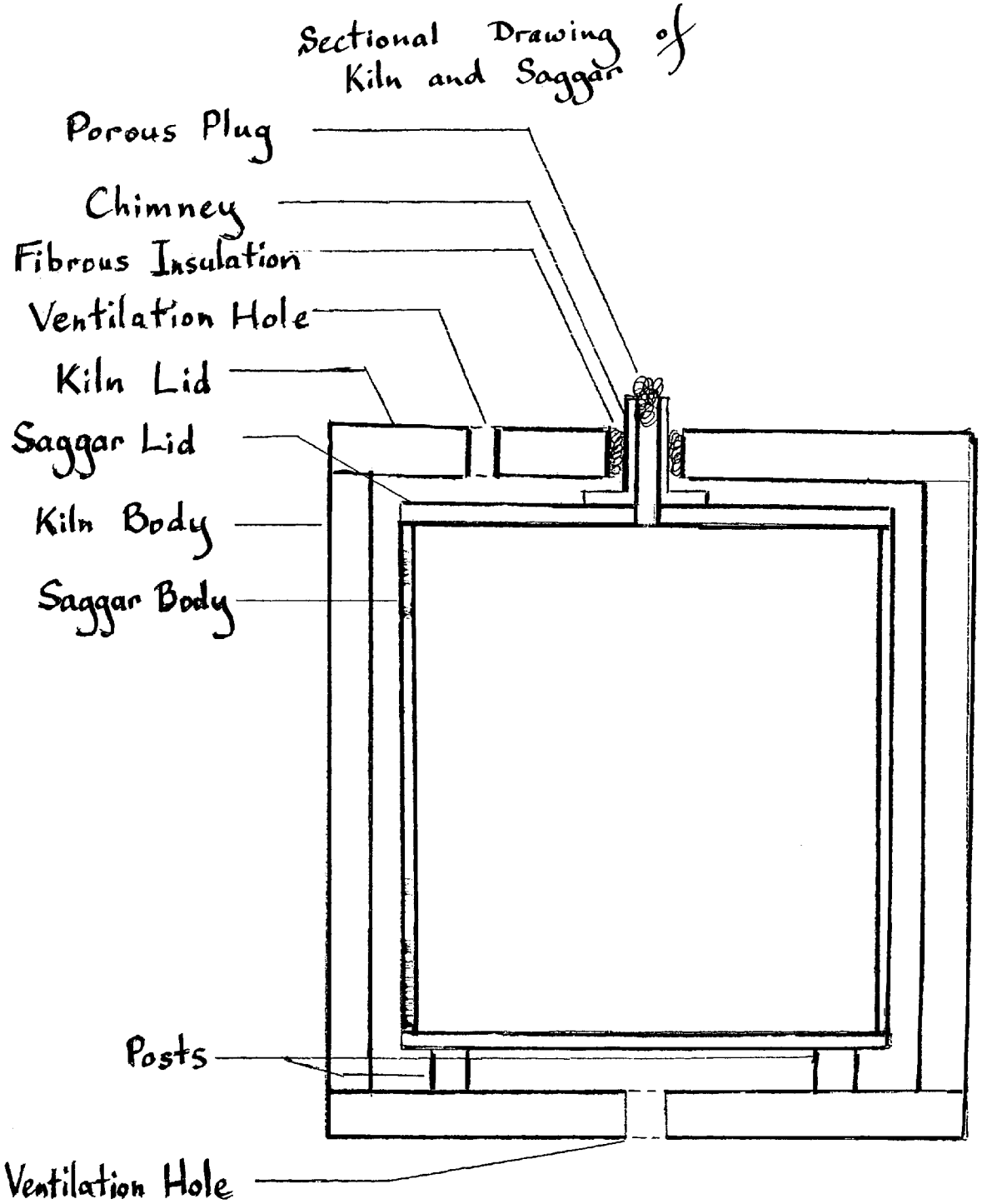
Sectional Drawing of Kiln and Saggar
Porous Plug
Chimney
Fibrous Insulation
Ventilation Hole
Kiln Lid
Saggar Lid
Kiln Body
Saggar Body
Posts
Ventilation Hole

FIRED POTTERY ITEMS AND A METHOD FOR THEIR MANUFACTURE

CROSS REFERENCE TO RELATED APPLICATION

The present application claims priority from U.S. Provisional Application Ser. No. 60/534,238, filed Jan. 6, 2004.

FIELD OF THE INVENTION

This invention relates to fired pottery and to a process for firing such.

DESCRIPTION OF RELATED ART

The firing of pottery in a modified atmosphere is well known. By restricting the air supply to the fire in a fuel fired kiln a reducing atmosphere is obtained. This has significant, often dramatic, effects on the clay body or, more especially, the glaze. An example is the production of spectacular copper reds from a glaze which would otherwise be pale green. A further example is the production of celadon glazes.

Another example of a modified kiln atmosphere is soda firing, in which sodium carbonate is introduced into the kiln during the final stages of firing. The carbonate decomposes, liberating sodium oxide vapor, which condenses on the wares, not only modifying the glazes, but forming a kind of glaze of itself.

All of these methods are normally carried out in a fuel fired kiln.

A long felt need in this art is for a method of carrying out these processes in an electric kiln, since electric kilns are much less expensive than kilns fired with gas or oil, and are simpler to operate. Attempts have been made to make reduced glazes in the electric kiln by adding, for example, naphthalene to the kiln during firing. This process has varied success, but suffers from the major disadvantage that the reducing atmosphere is very detrimental to the electric heating elements of the kiln. A further disadvantage is the liberation of noxious fumes.

A further need is for better control of the reducing atmosphere. The difficulty of obtaining copper red glazes even in a fuel-fired kiln is well known. Reference is made to Tichane, R. *Copper Red Glazes, a Guide to Producing These Elusive Glazes* (Krause Publications, Iola Wis., 1998).

SUMMARY OF THE INVENTION

I have found that pottery can be fired in a reducing or otherwise modified atmosphere in an electric kiln without unusual damage to the kiln elements. The principle of the invention is to enclose the wares to be fired in a saggar along with materials which produce the desired atmosphere at the appropriate temperatures. The saggar is vented to the atmosphere outside the kiln, and the kiln is also separately ventilated so that traces of potentially harmful vapors which may leak from the saggar are kept from contact with the kiln elements.

BRIEF DESCRIPTION OF THE DRAWINGS

For a more complete understanding of the present invention, reference should be made to the Description of the Preferred Embodiments, which is set below. This Description should be read together with the accompanying drawing, wherein:

FIG. 1 is a cross-sectional view showing the preferred embodiment of the instant invention.

DETAILED DESCRIPTION OF THE PREFERRED EMBODIMENT

The saggar is a ceramic container which fits inside the kiln. It is made of a material essentially impervious to air, and has a closely fitted lid with a chimney which protrudes through a hole provided in the lid of the kiln. The saggar chimney is fitted with a porous stopper that can be removed as desired. Larger saggars may be constructed in sections.

The kiln is provided with the above-mentioned hole, and in addition a hole in or near the bottom, to facilitate either convective or fan-assisted ventilation, and preferably an additional hole in the lid through which air may be introduced.

In order to provide a reducing atmosphere the wares are placed in the saggar along with a suitable quantity of combustible material, such as charcoal or carbon black. When the kiln becomes hot enough, the combustible material ignites, and, in the confined atmosphere of the saggar, forms carbon monoxide. The carbon monoxide is a powerful reducing agent which effects all of the desired results, including the consistent production of copper reds.

Preferred combustible materials include charcoal and carbon black.

It is necessary to provide a sufficient quantity and quality of charcoal or carbon black. The amount needed will vary with the size and material of the saggar, with the dimensions of its chimney, with the closeness of the fit of its lid, with the final temperature needed and the duration of the heating cycle.

I have found that not all varieties of charcoal and carbon black are sufficiently reactive to achieve reduction without the use of excessive amounts of said carbon. Charcoal must be ground to make more surface available. Carbon black must be of a fine particle size.

Since charcoal is by no means pure carbon, it should be put in a dish or dishes so that the residual ash is contained, and does not glaze the kiln shelf on which the charcoal is placed.

In order to minimize the leakage of any fumes from the saggar to the interior of the kiln, it is best to provide ventilation by blowing air through the kiln, rather than sucking, for the reason that a pressure drop from outside to inside the saggar will reduce leakage, whereas suction would promote leakage. The amount of ventilation should not, of course, be so much as to make impossible the attainment of the desired temperatures.

Ventilation from top to bottom is to be preferred since it offsets the temperature variation from top to bottom which normally occurs.

Needless to say, a new installation will require a certain amount of experimentation in order to achieve consistent results, particularly since the glaze formulas in use are legion. I have found that charcoal, 80 mesh or finer, in the total amount of 100 grams is sufficient to maintain a reducing atmosphere in a saggar of approximately 12 liters capacity when fired to cone 8 over seven to eight hours. A larger saggar of the same shape may be expected to need less charcoal in proportion to its volume, since the leakage of air around the rim is proportional to the square of the diameter, while the volume is as the cube of the linear dimension.

A simple test for the amount of charcoal or carbon black needed is to fire the kiln with a weighed amount of said carbon in the saggar, and to weigh the amount remaining. If the carbon is all consumed, and the wares are insufficiently reduced, more carbon is needed in the next experiment. If a surplus remains, less carbon might be effective.

It is commonly thought that the final stage in the production of copper reds and blues should be in an oxidizing atmosphere. This may be achieved by one of three methods:

1) The amount of charcoal in the saggar is adjusted so that a reducing atmosphere is obtained until the later stages of firing.

2) The porous stopper is removed from the saggar chimney in the later stages of firing so as to allow the carbon monoxide to escape and any residual charcoal to be fully oxidized to carbon dioxide.

3) The wares are fired in a reducing atmosphere to a suitable temperature, and, after cooling, refired in an oxidizing atmosphere.

In order to achieve the effect of "soda firing" the wares are placed in the saggar along with alkali metal carbonate or hydroxide, especially sodium carbonate, instead of, or in addition to, charcoal, according to the effect desired. The alkali metal hydroxide or carbonate should be contained in a ceramic dish or dishes, to prevent damage to the kiln shelf on which it is placed.

EXAMPLE 1

A glaze was made by mixing with water the following ingredients:

| | |
|---|---|
| Nepheline Syenite | 41.3 g. |
| Silica | 20.3 g. |
| Gerstley Borate | 11.8 g. |
| Calcium Carbonate | 11.8 g. |
| Custer Feldspar | 9.4 g. |
| Florida Kaolin | 2.2 g. |
| Tin Oxide | 1.1 g. |
| Cuprous Oxide | 0.4 g. |

The glaze was applied to two test tiles by dipping. One tile was fired in a saggar of approximately six liters volume along with 50 grams of 80 mesh charcoal. The other tile was fired in the same load but outside the saggar. The kiln was fired to cone 8. The tile inside the saggar was an orange-red color. The other was pale green.

EXAMPLE 2

A glaze was made by mixing with water the following ingredients:

| | |
|---|---|
| Gerstley Borate | 10.5 g. |
| Calcium Carbonate | 11.4 g. |
| Custer Feldspar | 76.5 g. |
| Tin Oxide | 1.0 g. |
| Cuprous Oxide | 0.3 g. |

The glaze was applied to two test tiles by dipping. One tile was fired in a saggar of approximately six liters volume along with 50 grams of 80 mesh charcoal. The other tile was fired in the same kiln load but outside the saggar. The kiln was fired to cone 8. The tile inside the saggar was a deep red color. The other was pale green.

EXAMPLE 3

A glaze was made by mixing with water the following ingredients:

| | |
|---|---|
| Gerstley Borate | 27.0 g. |
| Nepheline Syenite | 47.3 g. |
| Silica | 20.3 g. |
| Cuprous Oxide | 0.4 g. |

The glaze was applied to a test tile by dipping and fired to cone 6 in a saggar of approximately six liters volume along with 100 grams of 80 mesh charcoal. It gave an orange-red color.

EXAMPLE 4

A glaze was made by mixing with water the following ingredients:

| | |
|---|---|
| Kona f-4 Feldspar | 27.3 g. |
| Silica | 30.8 g. |
| Cuprous Oxide | 0.4 g. |
| Calcium Carbonate | 12.8 g. |
| Glaze Frit 111 (General Color & Chemical) | 12.2 g. |
| Florida Kaolin | 5.6 g. |
| Dolomite | 1.9 g. |
| Titanium Dioxide | 0.2 g. |

The glaze was applied to a test tile by dipping and fired to cone 6 in a saggar of approximately six liters volume along with 100 grams of 80 mesh charcoal. It gave a magenta color.

EXAMPLE 5

A glaze was made by mixing with water the following ingredients:

| | |
|---|---|
| Kona f-4 Feldspar | 43.8 g. |
| Silica | 27.4 g. |
| Cuprous Oxide | 0.335 g. |
| Calcium Carbonate | 27.4 g. |
| Florida Kaolin | 1.52 g. |
| Dolomite | 9.11 g. |
| Gerstley Borate | 9.11 g. |
| Barium Carbonate | 4.56 g. |
| Zinc Oxide | 1.82 g. |
| Titanium Dioxide | 4.44 g. |

The glaze was applied to a test tile by dipping and fired to cone 8 in a saggar of approximately six liters volume along with 70 grams of airfloat charcoal (Skylighter, Inc.). It gave a deep blue color.

I claim:

1. A method for firing pottery; comprising:

providing a saggar having a container portion and a chimney portion;

placing the pottery in the container portion of the saggar;

placing a combustible material selected from the group consisting of one or more charcoal, carbon black, alkali metal hydroxide, alkali metal carbonate and alkali metal bicarbonate into the saggar;

adding a material selected from the group consisting of copper and a copper compound to the combustible material;

placing the saggar into a kiln such that the chimney portion extends through an opening in the kiln; and firing the kiln such that the combustible material in the saggar ignites.

2. The method set forth in claim 1 wherein the copper compound is selected from the group consisting of cupric chloride and cuprous chloride.

* * * * *